US008875334B1

(12) United States Patent
Rotairo

(10) Patent No.: US 8,875,334 B1
(45) Date of Patent: Nov. 4, 2014

(54) VACUUM HOSE APPARATUS

(71) Applicant: Felicisimo Rotairo, San Lorenzo, CA (US)

(72) Inventor: Felicisimo Rotairo, San Lorenzo, CA (US)

( * ) Notice: Subject to any disclaimer, the term of this patent is extended or adjusted under 35 U.S.C. 154(b) by 0 days.

(21) Appl. No.: 13/898,604

(22) Filed: May 21, 2013

(51) Int. Cl.
*E04H 4/16* (2006.01)

(52) U.S. Cl.
CPC ..... *E04H 4/16* (2013.01); *E04H 4/1636* (2013.01)
USPC ..... 15/1.7

(58) Field of Classification Search
USPC ..... 15/1.7
See application file for complete search history.

(56) References Cited

U.S. PATENT DOCUMENTS

| | | | |
|---|---|---|---|
| 4,240,173 | A | 12/1980 | Sherrill |
| 5,082,028 | A | 1/1992 | Leonard |
| D358,235 | S | 5/1995 | Brooks et al. |
| 5,417,851 | A | 5/1995 | Yee |
| 7,328,473 | B2 | 2/2008 | Deklinski |
| 7,537,691 | B2 | 5/2009 | Reid |
| D660,526 | S | 5/2012 | Erlich et al. |
| 2004/0158943 | A1 | 8/2004 | Popielarczyk et al. |

*Primary Examiner* — Shay Karls

(57) ABSTRACT

A vacuum hose apparatus cleans a swimming pool without the use of a conventional pump. The apparatus includes a housing. A conduit extends through the housing between an inlet port and an outlet port. A suction port extends into the housing and is in environmental communication with the conduit wherein the conduit is configured for creating suction through the suction port as a fluid is passed from the inlet port to the outlet port. A bladder is positioned in the conduit between the inlet port and the suction port. A hole is positioned in the bladder wherein the bladder is configured for restricting the fluid as the fluid passes through the conduit increasing fluid pressure as the fluid passes through the hole. A supply hose is coupled to the inlet port and is configured for coupling to a fluid supply wherein fluid passes into the conduit through the inlet port.

15 Claims, 4 Drawing Sheets

VACUUM HOSE APPARATUS

BACKGROUND OF THE DISCLOSURE

1. Field of the Disclosure

The disclosure relates to hose apparatuses and more particularly pertains to a new hose apparatus for cleaning a swimming pool by removing contaminants from the pool without the use of a conventional pump.

2. Summary of the Disclosure

An embodiment of the disclosure meets the needs presented above by generally comprising a housing. A conduit extends through the housing between an inlet port and an outlet port. A suction port extends into the housing and is in environmental communication with the conduit wherein the conduit is configured for creating suction through the suction port as a fluid is passed from the inlet port to the outlet port. A bladder is positioned in the conduit between the inlet port and the suction port. A hole is positioned in the bladder wherein the bladder is configured for restricting the fluid as the fluid passes through the conduit increasing fluid pressure as the fluid passes through the hole. A supply hose is coupled to the inlet port and is configured for coupling to a fluid supply wherein fluid passes into the conduit through the inlet port.

There has thus been outlined, rather broadly, the more important features of the disclosure in order that the detailed description thereof that follows may be better understood, and in order that the present contribution to the art may be better appreciated, There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
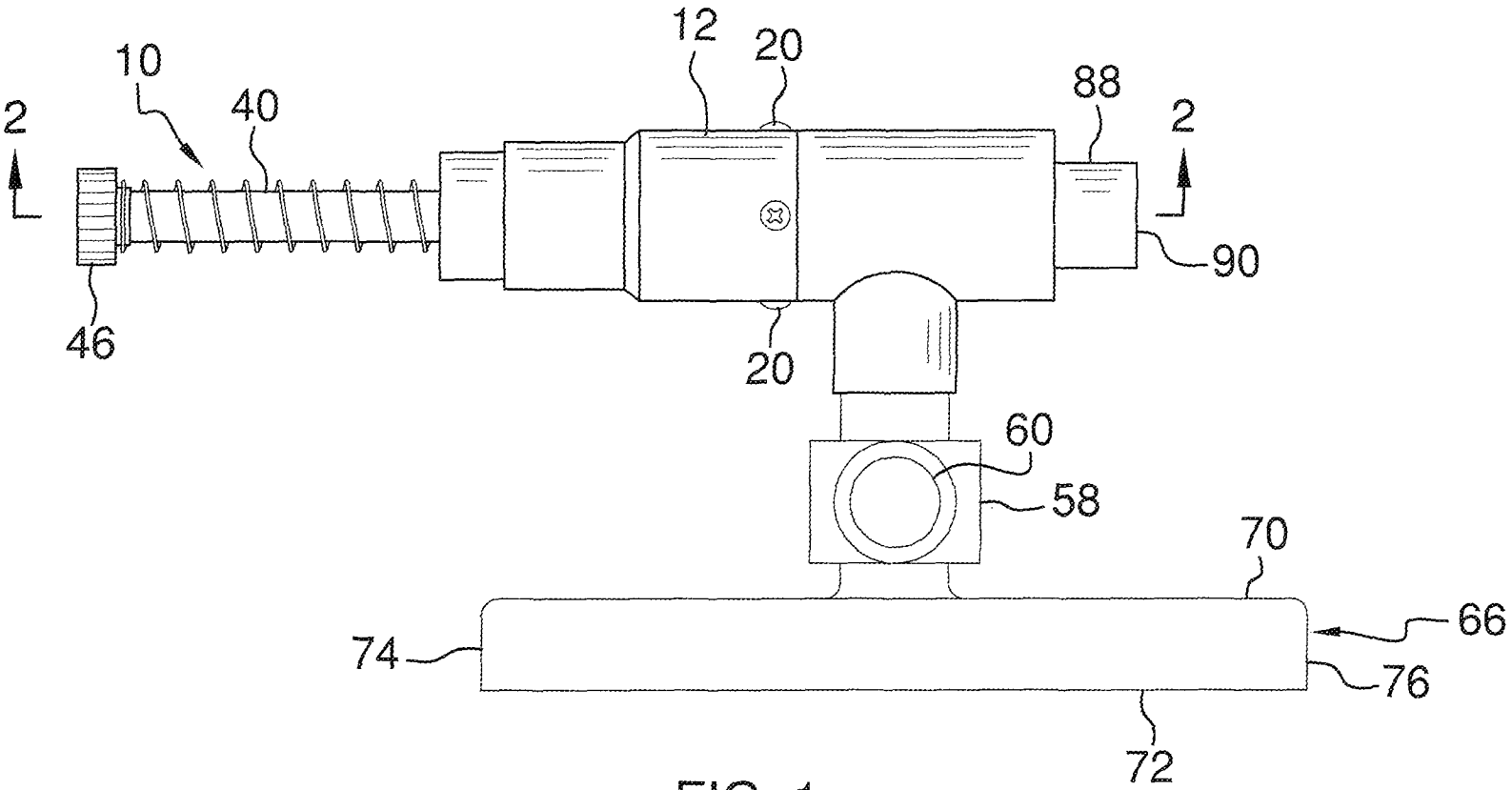
FIG. 1 is a side view of a vacuum hose apparatus according to an embodiment of the disclosure.
Figure 2:
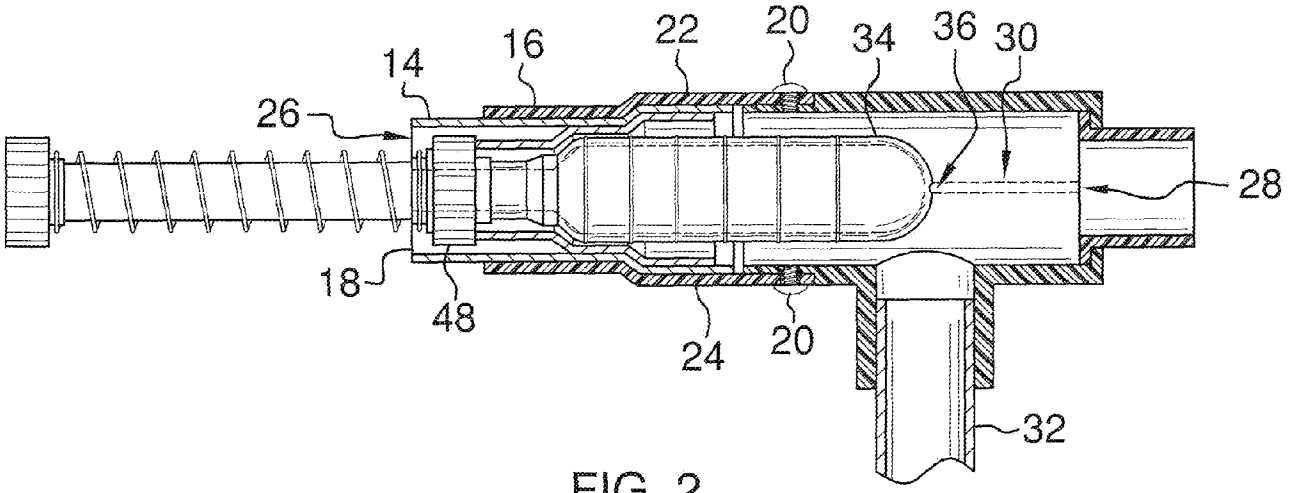
FIG. 2 is a cross-sectional view of an embodiment of the disclosure taken along line 2-2 of FIG. 1.
Figure 3:
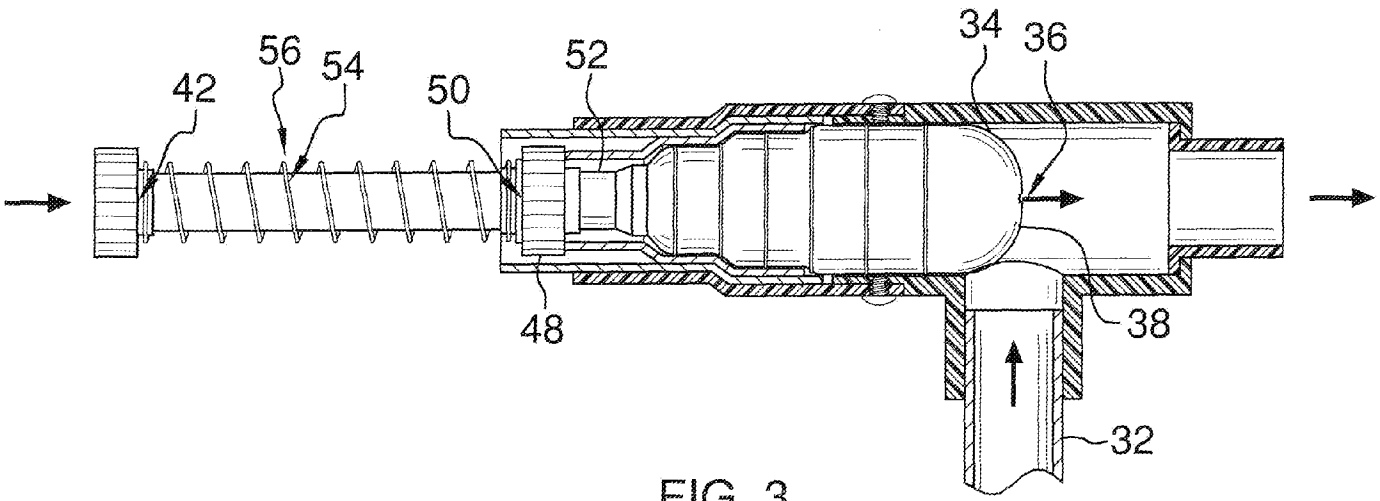
FIG. 3 is a cross-sectional view of an embodiment of the disclosure similar to FIG. 2, except that FIG. 3 shows fluid passing through the apparatus.
Figure 4:
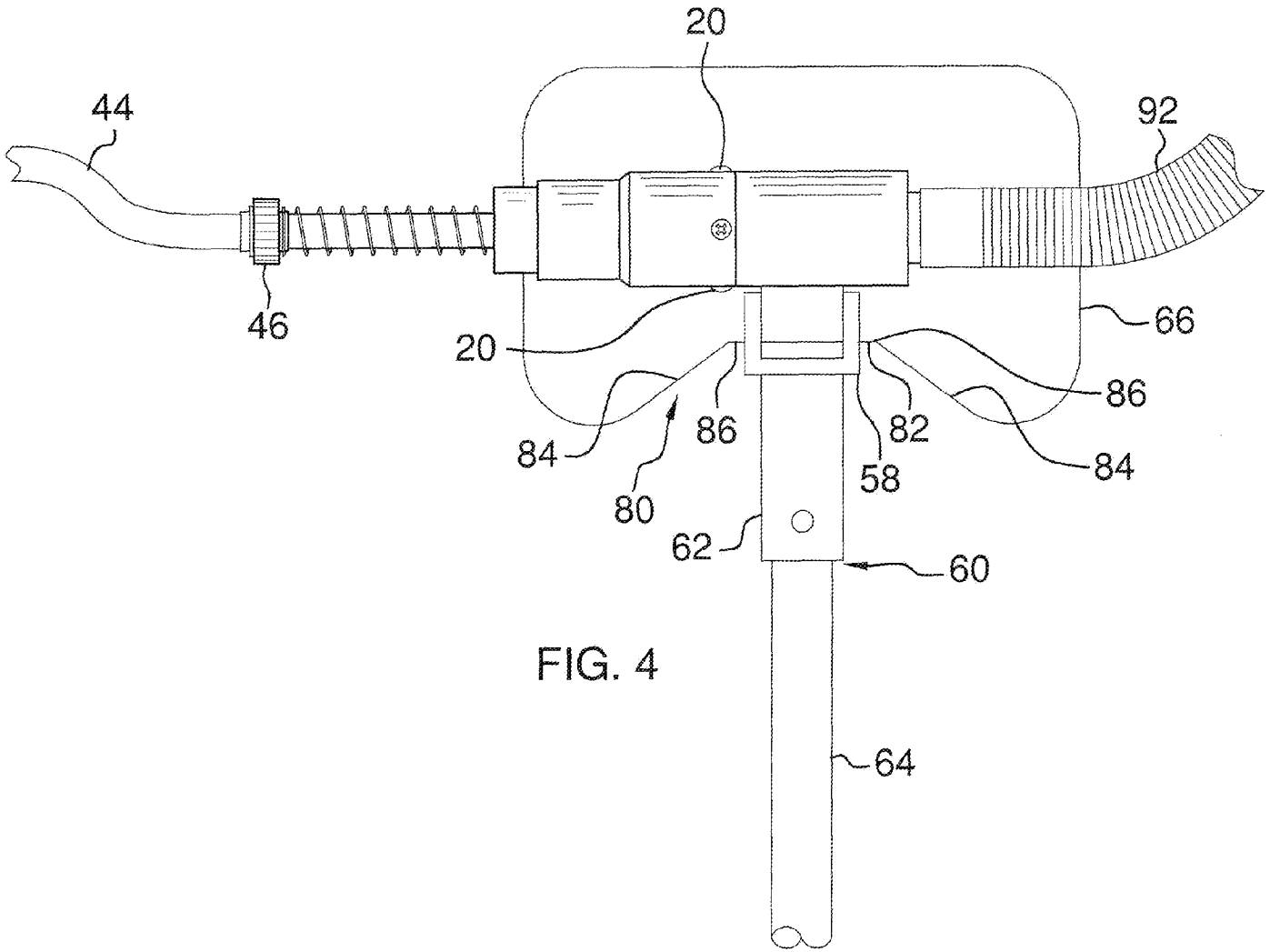
FIG. 4 is a top view of an embodiment of the disclosure.
Figure 5:
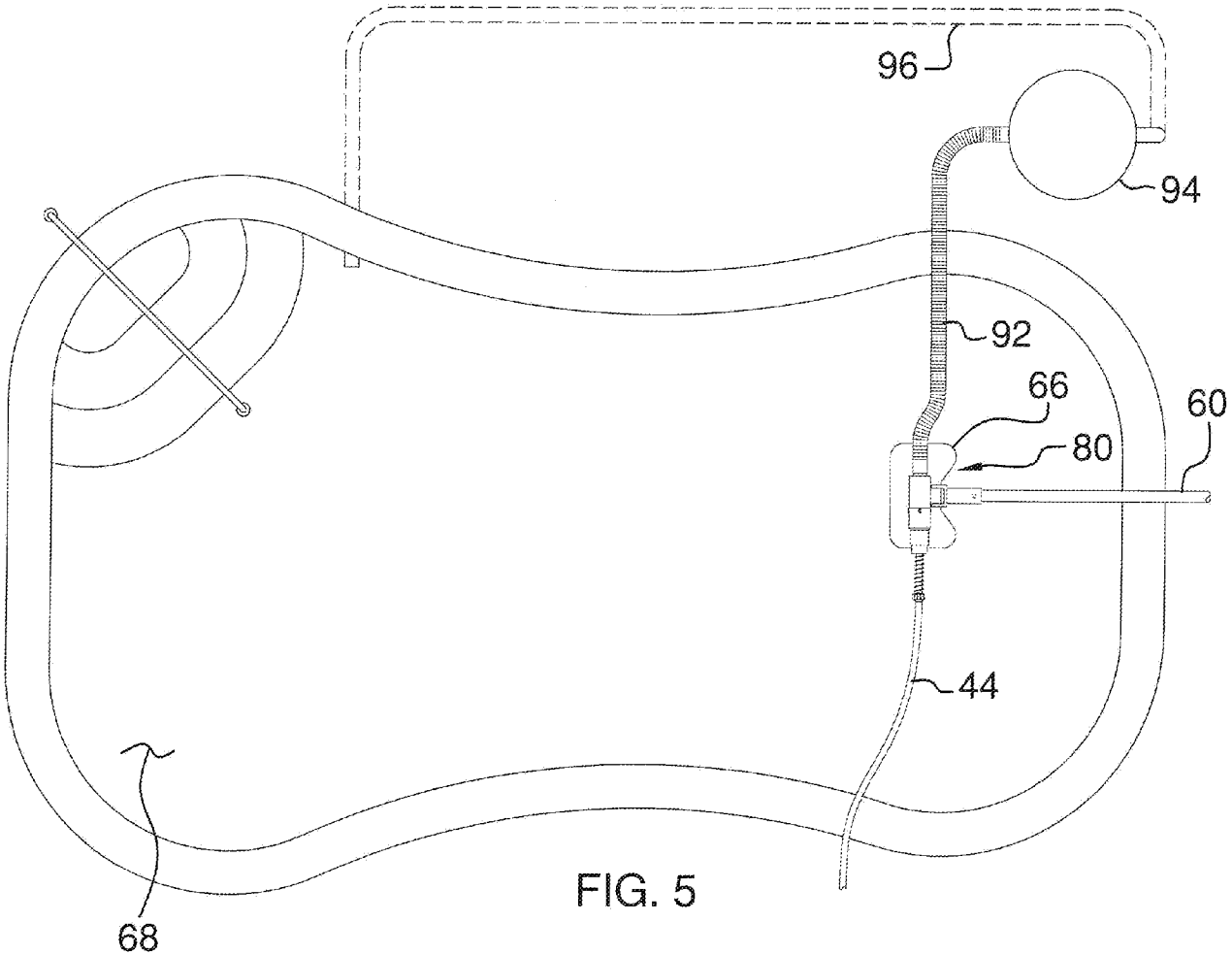
FIG. 5 is a top view of an embodiment of the disclosure in use.

With reference now to the drawings, and in particular to FIGS. 1 through 5 thereof, a new hose apparatus embodying the principles and concepts of an embodiment of the disclosure and generally designated by the reference numeral 10 will be described.

As best illustrated in FIGS. 1 through 5, the vacuum hose apparatus 10 generally comprises a housing 12 having a first shroud 14 and a second shroud 16. The second shroud 16 extends around the first shroud 14. A front end 18 of the first shroud 14 may extend outwardly from the second shroud 16.

The first shroud 14 and the second shroud 16 may be removably interlocked such that a pair of fasteners 20 couples the first shroud 14 and the second shroud 16. Each of the fasteners 20 may be positioned on an associated one of a top side 22 and a bottom side 24 of the housing 12.

An inlet port 26 extends through the housing 12. An outlet port 28 extends through the housing 12 and is preferably aligned with the inlet port 26. A conduit 30 extends through the housing 12 between the inlet port 26 and the outlet port 28. A suction port 32 extends into the housing 12 and is in environmental communication with the conduit 30 between the inlet port 26 and the outlet port 28 wherein the conduit 30 is configured for creating suction through the suction port 32 as a fluid is passed through the conduit 30 from the inlet port 26 to the outlet port 28. A bladder 34 is coupled to the housing 12. The bladder 34 is positioned in the conduit 30 between the inlet port 26 and the suction port 32. A hole 36 is positioned in a distal end 38 of the bladder 34 relative to the inlet port 26 wherein the bladder 34 is configured for restricting the fluid as the fluid passes through the conduit 30 increasing fluid pressure as the fluid passes through the hole 36.

A supply hose 40 is coupled to the inlet port 26. A distal end 42 of the supply hose 40 is configured for coupling to a fluid supply 44 wherein fluid passes into the conduit 30 through the inlet port 26. A first coupler 46 and a second coupler 48 are provided. The first coupler 46 is coupled to the distal end 42 of the supply hose 40 wherein the first coupler 46 is configured for coupling the supply hose 40 to the fluid supply 44. The second coupler 48 is coupled to a second end 50 of the supply hose 40 wherein the second coupler 48 is configured for coupling the supply hose 40 to the bladder 34. A collar 52 couples the second coupler 48 and the bladder 34. A biasing member 54 is coupled to and extends around the supply hose 40 wherein the biasing member 54 is configured to prevent the supply hose 40 from twisting relative to the housing 12. The biasing member 54 preferably comprises a spring 56.

A connector 58 is coupled to the housing 12. The connector 58 may be positioned nearer the outlet port 28 than the inlet port 26. An elongated handle 60 is coupled to the housing 12. The handle 60 is coupled to and extends outwardly from the connector 58. The handle 60 has a first sleeve 62 and a second sleeve 64. The second sleeve 64 may have an adjustable length relative to the first sleeve 62 wherein the second sleeve 64 is insertable and retractable a selectable distance into and out of the first sleeve 62.

A brush 66 is coupled to the suction port 32. The brush 66 is in environmental communication with the conduit 30 between the distal end 38 of the bladder 34 and the outlet port 28 wherein the brush 66 is configured for removing contaminants from an external surface 68, such as a swimming pool, upwardly into the suction port 32 as the brush 66 is positioned above the contaminants and the fluid passes through the conduit 30 from the inlet port 26 to the outlet port 28. In addition to a swimming pool, the apparatus 10 may be used anywhere that liquids must be sucked up, such as a flooded basement. The brush 66 has a top side 70 opposite a bottom side 72 and a first side 74 opposite a second side 76. The top side 70 may have a plurality of concavely arcuate edges 78 such that each of the first side 74 and the second side 76 of the brush 66 has an associated pair of the arcuate edges 78. The first side 74 of the brush 66 is preferably straight. The second side 76 of the brush 66 has a medial portion 80 extending between the associated arcuate edges 78. The medial portion 80 of the brush 66 has a straight section 82 and a pair of slanted sections 84 coupled to and extending outwardly from opposite ends 86 of the straight section 82. The brush 66 is in fluid communication with the conduit 30 between the distal end 38 of the bladder 34 and the outlet port 28 wherein the brush 66 is configured for removing a liquid from the external surface 68 upwardly into the suction port 32 as the brush 66 is positioned above the liquid and the fluid passes through the conduit 30 from the inlet port 26 to the outlet port 28.

A nozzle 88 is coupled to the outlet port 28. A distal end 90 of the nozzle 88 is configured for coupling to a discharge hose 92 wherein the fluid, the liquid, and the contaminants are expelled outwardly of the conduit 30 through the discharge hose 92 as the brush 66 is positioned above the contaminants and the liquid and the fluid passes through the conduit 30 between the inlet port 26 and the outlet port 28. The nozzle 88 may have a circumference between 2.5 centimeters and 3.5 centimeters. The discharge hose 92 is preferably coupled to a filtering system 94 to clean the liquid removed from the external surface 68. A return hose 96 may be coupled to the filtering system 94 to return the clean liquid back to the external surface 68 if desired.

In use, as stated above and shown in the Figures, the fluid supply 44 is coupled to the supply hose 40 and a discharge hose 92 is coupled to the nozzle 88. A brush 66 is coupled to the suction port 32 and positioned in an external surface 68 to be cleaned, such as a swimming pool. The conduit 30 creates suction through the suction port 32 as a fluid is passed through the conduit 30 from the inlet port 26 to the outlet port 28. The suction draws contaminants and liquids upwardly from the external surface 68 into the conduit 30 and out through the discharge hose 92. In this manner, the contaminants and the water in the swimming pool are removed in order to clean the pool without needing electricity to run a conventional pump. Thus, fewer chemicals need be used to clean the pool saving both time and money for the user. The filtering system 94 and return hose 96 are used to clean the liquid and return it back to the external surface 68.

With respect to the above description then, it is to be realized that the optimum dimensional relationships for the parts of an embodiment enabled by the disclosure, to include variations in size, materials, shape, form, function and manner of operation, apparatus and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A vacuum hose apparatus for use in cleaning a swimming pool, said apparatus comprising:

a housing;

an inlet port extending through said housing;

an outlet port extending through said housing, said outlet port being aligned with said inlet port;

a conduit extending through said housing between said inlet port and said outlet port;

a suction port extending into said housing, said suction port being in environmental communication with said conduit between said inlet port and said outlet port wherein said conduit is configured for creating suction through said suction port as a fluid is passed through said conduit from said inlet port to said outlet port;

a bladder coupled to said housing, said bladder being positioned in said conduit between said inlet port and said suction port;

a hole positioned in a distal end of said bladder relative to said inlet port wherein said bladder is configured for restricting the fluid as the fluid passes through said conduit increasing fluid pressure as the fluid passes through said hole; and a supply hose coupled to said inlet port, a distal end of said supply hose being configured for coupling to a fluid supply wherein fluid passes into said conduit through said inlet port.

2. The apparatus of claim 1, further comprising said housing comprising a first shroud and a second shroud, said second shroud extending around said first shroud, a front end of said first shroud extending outwardly from said second shroud.

3. The apparatus of claim 2, further comprising said first shroud and said second shroud being removably interlocked.

4. The apparatus of claim 3, further comprising a pair of fasteners coupling said first shroud and said second shroud, each of said fasteners being positioned on an associated one of a top side and a bottom side of said housing.

5. The apparatus of claim 1, further comprising:

a first coupler coupled to said distal end of said supply hose wherein said first coupler is configured for coupling said supply hose to the fluid supply; and a second coupler coupled to a second end of said supply hose wherein said second coupler is configured for coupling said supply hose to said bladder.

6. The apparatus of claim 5, further comprising a collar coupling said second coupler and said bladder.

7. The apparatus of claim 1, further comprising a biasing member coupled to and extending around said supply hose wherein said biasing member is configured to prevent said supply hose from twisting relative to said housing, said biasing member comprising a spring.

8. The apparatus of claim 1, further comprising:

a connector coupled to said housing, said connector being positioned nearer said outlet port than said inlet port; and an elongated handle coupled to said housing, said handle being coupled to and extending outwardly from said connector.

9. The apparatus of claim 8, further comprising said handle having a first sleeve and a second sleeve, said second sleeve having an adjustable length relative to said first sleeve wherein said second sleeve is insertable and retractable a selectable distance into and out of said first sleeve.

10. The apparatus of claim 1, further comprising a brush coupled to said suction port, said brush being in environmental communication with said conduit between said distal end of said bladder and said outlet port wherein said brush is configured for removing contaminants from an external surface upwardly into said suction port as said brush is positioned above the contaminants and the fluid passes through said conduit from said inlet port to said outlet port.

11. The apparatus of claim 10, further comprising said brush being in fluid communication with said conduit between said distal end of said bladder and said outlet port wherein said brush is configured for removing a liquid from the external surface upwardly into said suction port as said brush is positioned above the liquid and the fluid passes through said conduit from said inlet port to said outlet port.

12. The apparatus of claim 11, further comprising said brush having a top side opposite a bottom side and a first side opposite a second side, said top side having a plurality of concavely arcuate edges, each of said first side and said second side of said brush having an associated pair of said arcuate edges.

13. The apparatus of claim 12, further comprising said first side of said brush being straight, said second side of said brush having a medial portion extending between said associated arcuate edges, said medial portion of said brush having a straight section and a pair of slanted sections coupled to and extending outwardly from opposite ends of said straight section.

14. The apparatus of claim 11, further comprising a nozzle coupled to said outlet port, a distal end of said nozzle being configured for coupling to a discharge hose wherein the fluid, the liquid, and the contaminants are expelled outwardly of said conduit through the discharge hose as said brush is positioned above the liquid and the contaminants and the fluid passes through said conduit between said inlet port and said outlet port.

15. A vacuum hose apparatus for use in cleaning a swimming pool, said apparatus comprising:

a housing, said housing comprising a first shroud and a second shroud, said second shroud extending around said first shroud, a front end of said first shroud extending outwardly from said second shroud, said first shroud and said second shroud being removably interlocked;

a pair of fasteners coupling said first shroud and said second shroud, each of said fasteners being positioned on an associated one of a top side and a bottom side of said housing;

an inlet port extending through said housing;

an outlet port extending through said housing, said outlet port being aligned with said inlet port;

a conduit extending through said housing between said inlet port and said outlet port;

a suction port extending into said housing, said suction port being in environmental communication with said conduit between said inlet port and said outlet port wherein said conduit is configured for creating suction through said suction port as a fluid is passed through said conduit from said inlet port to said outlet port;

a bladder coupled to said housing, said bladder being positioned in said conduit between said inlet port and said suction port;

a hole positioned in a distal end of said bladder relative to said inlet port wherein said bladder is configured for restricting the fluid as the fluid passes through said conduit increasing fluid pressure as the fluid passes through said hole;

a supply hose coupled to said inlet port, a distal end of said supply hose being configured for coupling to a fluid supply wherein fluid passes into said conduit through said inlet port;

a first coupler and a second coupler, said first coupler being coupled to said distal end of said supply hose wherein said first coupler is configured for coupling said supply hose to the fluid supply, said second coupler being coupled to a second end of said supply hose wherein said second coupler is configured for coupling said supply hose to said bladder;

a collar coupling said second coupler and said bladder;

a biasing member coupled to and extending around said supply hose wherein said biasing member is configured to prevent said supply hose from twisting relative to said housing, said biasing member comprising a spring;

a connector coupled to said housing, said connector being positioned nearer said outlet port than said inlet port;

an elongated handle coupled to said housing, said handle being coupled to and extending outwardly from said connector, said handle having a first sleeve and a second sleeve, said second sleeve having an adjustable length relative to said first sleeve wherein said second sleeve is insertable and retractable a selectable distance into and out of said first sleeve;

a brush coupled to said suction port, said brush being in environmental communication with said conduit between said distal end of said bladder and said outlet port wherein said brush is configured for removing contaminants from an external surface upwardly into said suction port as said brush is positioned above the contaminants and the fluid passes through said conduit from said inlet port to said outlet port, said brush being in fluid communication with said conduit between said distal end of said bladder and said outlet port wherein said brush is configured for removing a liquid from the external surface upwardly into said suction port as said brush is positioned above the liquid and the fluid passes through said conduit from said inlet port to said outlet port, said brush having a top side opposite a bottom side and a first side opposite a second side, said top side having a plurality of concavely arcuate edges, each of said first side and said second side of said brush having an associated pair of said arcuate edges, said first side of said brush being straight, said second side of said brush having a medial portion extending between said associated arcuate edges, said medial portion of said brush having a straight section and a pair of slanted sections coupled to and extending outwardly from opposite ends of said straight section; and a nozzle coupled to said outlet port, a distal end of said nozzle being configured for coupling to a discharge hose wherein the fluid, the liquid, and the contaminants are expelled outwardly of said conduit through the discharge hose as said brush is positioned above the liquid and the contaminants and the fluid passes through said conduit between said inlet port and said outlet port.

* * * * *